United States Patent [19]

Tu

[11] 4,348,272

[45] Sep. 7, 1982

[54] HYDROGEN UTILIZATION IN FLUID CATALYTIC CRACKING

[75] Inventor: Hosheng Tu, Shorewood, Ill.

[73] Assignee: UOP, Inc., Des Plaines, Ill.

[21] Appl. No.: 170,373

[22] Filed: Jul. 21, 1980

[51] Int. Cl.[3] ..... C10G 47/20; C10G 47/30

[52] U.S. Cl. ..... 208/111; 208/52 CT; 208/56; 208/120; 252/420

[58] Field of Search ..... 208/120, 111, 52 CT, 208/56; 252/411 R, 420; 423/650–658

[56] References Cited

U.S. PATENT DOCUMENTS

| | | | |
|---|---|---|---|
| 3,413,212 | 11/1968 | Weisz | 208/120 |
| 3,844,973 | 10/1974 | Stine et al. | 208/120 X |
| 3,963,830 | 6/1976 | Kasai et al. | 423/579 |
| 4,162,213 | 7/1979 | Zrinscak et al. | 208/89 |
| 4,268,376 | 5/1981 | Foster | 208/120 |
| 4,268,416 | 5/1981 | Stine et al. | 208/120 X |

*Primary Examiner*—Delbert E. Gantz
*Assistant Examiner*—G. E. Schmitkons
*Attorney, Agent, or Firm*—James R. Hoatson, Jr.; Louis A. Morris; William H. Page, II

[57] ABSTRACT

An FCC process in which hydrogen produced by water thermolysis adheres to the catalyst and is used in the reaction zone to achieve improved product selectivity and reduced coke production. The catalyst used is a crystalline aluminosilicate cation exchanged with transitional metal cations. The water thermolysis is carried out in the circulating catalyst upstream of the reaction zone at water thermolysis conditions.

6 Claims, No Drawings

HYDROGEN UTILIZATION IN FLUID CATALYTIC CRACKING

BACKGROUND OF THE INVENTION

1. Field of the Invention

The field of art to which the claimed invention pertains is the catalytic cracking of hydrocarbons. More specifically, the claimed invention relates to a process for the utilization of hydrogen obtained by water thermolysis in a fluid catalytic cracking process.

2. Description of the Prior Art

There are a number of continuous cyclical processes employing fluidized solid techniques in which carbonaceous materials are deposited on the solids in the reaction zone and the solids are conveyed during the course of the cycle to another zone where carbon deposits are at least partially removed by combustion in an oxygen-containing medium. The solids from the latter zone are subsequently withdrawn and reintroduced in whole or in part to the reaction zone.

One of the more important processes of this nature is the fluid catalytic cracking (FCC) process for the conversion of relatively high-boiling hydrocarbons to lighter hydrocarbons boiling in the heating oil or gasoline (or lighter) range. The hydrocarbon feed is contacted in one or more reaction zones with the particulate cracking catalyst maintained in a fluidized state under conditions suitable for the conversion of hydrocarbons.

The selectivity to the desired gasoline fraction in the FCC process is limited by the overall hydrogen balance, i.e. the available hydrogen. Although the providing of hydrogen gas from an outside source in the range of a few weight percent of the feed or even a few weight ppm would greatly enhance the FCC process selectivity, hydrogen is expensive and is generally not considered for addition to that process. For example, in U.S. Pat. No. 3,413,212 the advantages of hydrogen addition to the FCC process are shown, but reliance is placed on expensive and impractical means such as hydrogen donor materials added to the charge stock from external sources or derived by partial hydrogenation of aromatic hydrocarbons in the charge stock.

In U.S. Pat. No. 3,963,830 it is disclosed that crystalline zeolite structures, into which certain trivalent cations are added by cation exchange procedures, are capable of thermochemically decomposing water (water thermolysis) in a cyclic process which alternates the production of oxygen and hydrogen. In one part of the cycle the trivalent cations are reduced while interracting with water and the water molecules are decomposed with the consequent evolution of oxygen. In the other part of the cycle the bivalent metal cations are reoxidized by imposing different operating conditions also in the presence of water.

I have discovered a technique for utilizing water thermolysis in the FCC process so as to make hydrogen available in the cracking reaction and to achieve improved cracking selectivity and reduced coke production.

SUMMARY OF THE INVENTION

It is, accordingly, a broad objective of my process to make hydrogen available in the cracking zone of an FCC process.

In brief summary, my invention is a fluidized catalytic cracking process wherein the catalyst employed comprises a crystalline aluminosilicate the exchangeable cationic sites of which have been ion-exchanged with cations of a non-noble transitional metal, the catalyst being cycled betwen a cracking zone, in which the catalyst is contacted at an elevated temperature with a hydrocarbon feedstock, and a regeneration zone, in which carbon is oxidized and thereby removed from the catalyst, the process comprising maintaining the catalyst under water thermolysis conditions prior to passing the catalyst into the cracking zone, whereby hydrogen is produced and then adsorbed on the catalyst, thereby making the hydrogen available in the cracking zone to effect improved cracking selectivity and reduced coke production.

Other objectives and embodiments of my invention encompass details about catalyst composition, flow schemes, and reaction conditions, all of which are hereinafter disclosed in the following discussion of each of the facets of the invention.

DESCRIPTION OF THE INVENTION

In a typical FCC process flow, finely divided regenerated catalyst leaves the regeneration zone at a certain temperature, passes to the reactor via a dipleg and contacts a feedstock in a lower portion of a reactor riser zone. While the resulting mixture, which has a temperature of from about 400° F. to about 1300° F., passes up through the riser, conversion of the feed to lighter products occurs and coke is deposited on the catalyst. The effluent from the riser is discharged into a disengaging space when additional conversion can take place. The hydrocarbon vapos, containing entrained catalyst, are then passed through one or more cyclone separation means to separate any spent catalyst from the hydrocarbon vapor stream. The separated hydrocarbon vapor stream is passed into a fractionation zone known in the art as the main column wherein the hydrocarbon effluent is separated into such typical fractions as light gases and gasoline, light cycle oil, heavy cycle oil and slurry oil. Various fractions from the main column can be recycled along with the feedstock to the reactor riser. Typically, fractions such as light gases and gasoline are further separated and processed in a gas concentration process located downstream of the main column. Some of the fractions from the main column, as well as those recovered from the gas concentration process may be recovered as final product streams. The separated spent catalyst passes into the lower portion of the disengaging space and eventually leaves that zone passing through stripping means in which a stripping gas, usually steam, contacts the spent catalyst purging adsorbed and interstitial hydrocarbons from the catalyst. The spent catalyst containing coke leaves the stripping zone and passes into a regeneration zone, where, in the presence of fresh regeneration gas and at a temperature of from about 1150° F. to about 1400° F., combustion of coke produces regenerated catalyst and flue gas containing carbon monoxide, carbon dioxide, water, nitrogen and perhaps a small quantity of oxygen. Usually, the fresh regeneration gas is air, but it could be air enriched or deficient in oxygen. Flue gas is separated from entrained regenerated catalyst by cyclone separation means located within the regeneration zone and separated flue gas is passed from the regeneration zone, typically, to a carbon monoxide boiler where the chemical heat of carbon monoxide is recovered by combustion as a fuel for the production of steam, or, if carbon monoxide combustion in the regeneration zone is complete, which is the preferred mode of operation, the flue gas passes directly to sensible heat recovery means and from there to a refinery stack. Regenerated catalyst which was separated from the flue gas is returned to the lower portion of the regeneration zone which typically is maintained at a higher catalyst density. A stream of regenerated catalyst leaves the regeneration zone via the dipleg and, as previously mentioned, contact the feedstock in the reaction zone.

Catalysts which can be used in the process of this invention include those known to the art as fluidized catalytic cracking catalysts. Specifically, the high activity aluminosilicate or zeolite-containing catalysts are to be used, particularly X type zeolite, Y type zeolite or mordenite. The invention requires that the exchangeable cationic sites of the catalyst be ion exchanged, by ion exchange techniques well-known to the art, with cations of a non-noble transitional metal, particularly a metal included in the group comprising the polyvalent metals such as copper, nickel, cobalt, iron, chromium, molybdenum, tungsten, vanadium or titanium. It is essential that the cation be incorporated within the catalyst by ion exchange rather than by other techniques such as co-precipitation, co-gelling or impregnation, because it is only ion exchange that will result in the cation becoming part of the structure of the crystalline aluminosilicate which enables the electron sharing necessary for the thermolysis reaction. The non-noble transitional metal will comprise from about 0.1 wt. % to about 10.0 wt. % of the catalyst, and preferably from about 0.1 wt. % to about 1.0 wt. %.

Without being limited to any theory, it is my hypothesis that the thermolysis reaction mechanism is as follows (with chromium shown as the cation for illustrative purposes):

$$2Cr^{3+}(\text{zeolite})+H_2O \rightarrow 2Cr^{2+}(\text{zeolite})+\tfrac{1}{2}O_2+2H^{+}(\text{zeolite})$$

Thus, the hydrogen species formed in the reaction adheres to the zeolite in some manner, such as adsorption or chemical combination, and is carried to the reaction zone from the location from where the thermolysis reaction occurs, which is upstream of the reaction zone and preferably in the conduit or dipleg through which the catalyst passes from the regeneration zone to the cracking zone. The zeolite containing catalyst with the bound hydrogen species is then contacted with the feedstock where, in addition to the normal cracking reactions, the bound hydrogen is transferred to the products which results in improved cracking selectivity and reduced coke production. The catalyst is then rehydrated, preferably in the steam stripping section following the cracking zone, perhaps in accordance with the following mechanism:

$$Cr^{+2}(\text{zeolite})+H_2O \rightarrow Cr^{+3}(\text{zeolite})+OH^{--}(\text{zeolite})+\tfrac{1}{2}H_2$$

The thermolysis and rehydration reactions are, therefore, essentially the same as set forth in U.S. Pat. No. 3,963,830, discussed above, with the important distinction that in the process of this invention it is not the rehydration step that frees the hydrogen species, but the contact with the hydrocarbon feed.

The catalyst of this invention must be maintained under water thermolysis conditions for water thermolysis to occur. One of these conditions is a temperature greater than about 900° F., but no higher than the maximum thermal stability temperature of the catalyst, i.e. that temperature above which the crystalline aluminosilicate structure of the catalyst tends to disintegrate. An equally important condition is that the water content of the catalyst should be greater than about 0.1 wt. %, but no greater than about 5.0 wt. % and preferably no greater than about 1.0 wt. %. Care, therefore, must be exercised in the amount of water added to the catalyst upstream of where the water thermolysis is to occur, i.e. the dipleg, the usual source of such water being stripping and fluidizing stream.

The following non-limiting examples are illustrative of the principles and process of the present invention.

EXAMPLE I

In this example, a Cr-Mordenite containing catalyst was prepared by co-extruding Cr-Mordenite zeolite and alumina at a ratio of 75 wt. % mordenite to 25 wt. % alumina on a volatile free basis. The Cr-mordenite had been prepared by ion-exchanging the Na-Mordenite (supplied by Norton Chemical Co.) with chromium nitrate solution to 0.75 wt. % Cr on mordenite powder. The extrudate was calcined at 200° F. for 1 hour, after which time it contained about 2 wt. % $H_2O$. The catalyst was coded Catalyst A.

Three hundred and nine grams of Catalyst A were loaded in a pilot plant for zeolite water thermolysis evaluation. The plant was purged with nitrogen throughout the test. The reactor temperature was raised to 1000° F. over a period of about 5 hours. The amount of oxygen evolved and collected was 106 ml at STP (standard temperature @0° C. and standard pressure @1 atm conditions). It is apparent that chromium ion on mordenite zeolites function as a reaction site for water thermolysis.

EXAMPLE II

In this example, a Cr-Y zeolite containing catalyst was prepared by co-extruding Cr-Y zeolite and alumina at a ratio of 75 wt. % Y zeolite to 25 wt. % alumina on the volatile free basis. The Cr-Y zeolite had been prepared prior to extusion by ion exchanging the Na-Y powder with chromium nitrate solution. The wt. % Cr on the Y zeolite powder was 4.1 while the wt. % $Na_2O$ was 0.5 (both on a volatile free basis). The extrudate was calcined at 1300° F. for ½ hour. The catalyst was coded Catalyst B.

Three hundred and five grams of Catalyst B were loaded in the same pilot plant as shown in Example No. I. The plant was purged with nitrogen throughout the test. At the start of the test the catalyst contained about 2 wt. % $H_2O$. The reactor temperature was raised from room temperature to 1200° F. The amount of oxygen evolved in this case was 395 ml at STP over a period of about 5 hours.

To study the regenerability of a Cr-Y containing catalyst (Catalyst B) the catalyst from the above test was cooled to about 100° F. Steam was admitted to oxidize the catalyst. Then nitrogen was used to purge the reactor bed and the test was repeated to see if the catalyst was still active in zeolite water thermolysis. The reactor temperature was raised slowly to 1200° F. while the water content of the catalyst was reduced to about 2 wt. %. The amount of oxygen evolved in this second test was 375 ml at STP. It is clear that the catalyst of this invention could sustain the cycles of hydration-dehydration.

EXAMPLE III

In this example, a Cr-Y zeolite containing catalyst was prepared following the same procedures as in Example No. II. The composition included 25 wt. % of alumina and 75 wt. % Y zeolite which contained about 6.1 wt. % Cr on zeolite powder. The wet extrudate was calcined at 1300° F. for ½ hour. This catalyst was coded Catalyst C.

For comparison purposes, a Rare earth (RE)-Y zeolie containing catalyst was prepared. This zeolite had 15.6 wt. % rare earths and 4.2 wt. % $Na_2O$. A catalyst with 25 wt. % alumina and 75 wt. % RE-Y zeolite was prepared following the same procedures as for Catalyst C. This catalyst was coded Catalyst D.

Catalyst C and Catalyst D were evaluated in the same oxygen evolution pilot plant as shown in Example No. I. The plant was purged with nitrogen gas throughout the test. The reactor temperature was slowly raised to 1200° F. Both catalysts contained about 2 wt. % $H_2O$ at the start of the evaluation. The results are shown in Table No. 1.

TABLE 1

| WATER THERMOLYSIS TEST | | |
|---|---|---|
| Catalyst | C | D |
| Loading wt., g | 184 | 246 |
| Amount of Oxygen Evolved, ml @ STP | 520 | 9 |

In this comparison, the rare earth Y clearly did not function as an active component in zeolite water thermolysis. The trace oxygen evolved may have been due to an impurity of transitional metals contaminating Catalyst D.

EXAMPLE IV

In this example, Catalyst C (ground and screened to FCC size of about 70 microns) was evaluated in an FCC mode microactivity test pilot plant (MAT). MAT uses 4.0 grams of catalyst on a volatile free basis with 1.28 grams of vacuum gas oil as feedstock. The reactor temperature was 900° F. In the MAT Test No. 1, a standard procedure without extensive catalyst preheating was followed. Supposedly no excess hydrogen was generated on the catalyst due to insufficient water thermolysis conditions, i.e. a water content of over 5 wt. %. The MAT Test No. 2 utilized the same Catalyst C. However, the catalyst was preheated in-situ to 1000° F. for one hour under nitrogen purge to lower the catalyst LOI down to zeolite water thermolysis conditions, i.e. about 2 wt. %. The evolved oxygen would be blown out along with the purge gas while the generated hydrogen would stay on the zeolite sites of the Catalyst C. The MAT test results are shown in Table No. 2.

TABLE 2

| MAT RESULTS | | |
|---|---|---|
| Catalyst | C | C |
| Test No. | 1 | 2 |
| Zeolite Water Thermolysis | No | Yes |
| Wt. % Conversion | 58.7 | 74.7 |
| Product Distribution (Wt. % of product) | | |
| $C_2^-$ | 3.53 | 3.18 |
| Total $C_3$ | 7.38 | 7.02 |
| Total $C_4$ | 15.52 | 14.33 |
| $C_5$ - EP Gasoline | 20.76 | 42.60 |
| 450 + B.P. | 36.47 | 20.51 |
| Spent Catalyst Carbon | 16.34 | 12.36 |

The MAT test results clearly indicate that the catalyst of this invention with proper water thermolysis conditions improves the FCC cracking selectivity, i.e. higher gasoline selectivity and lower coke formation.

I claim as my invention:

1. A fluidized catalytic cracking process employing a catalyst comprising a crystalline aluminosilicate, the exchangeable cationic sites of which have been ion exchanged with cations of a non-noble transitional metal, said catalyst being cycled between a cracking zone, in which said catalyst is contacted at an elevated temperature with a hydrocarbon feedstock, and a regeneration zone, in which carbon is oxidized and thereby removed from said catalyst, said process comprising subjecting said catalyst, while in transit from said regeneration zone to said cracking zone, to water thermolysis at a temperature from about 900° F. to a maximum thermal stability temperature of said catalyst and a catalyst water content of from about 0.1 wt% to about 5.0%, thereby forming hydrogen which is retained by the catalyst, introducing said hydrogen to said cracking zone with the catalyst, and releasing the hydrogen from the catalyst by contact of the latter with said hydrocarbon feedstock in the cracking zone to effect improved cracking selectivity and reduced coke production.

2. The process of claim 1 wherein said water content is from about 0.1 wt. % to about 1.0 wt. %.

3. The process of claim 1 wherein said non-noble transitional metal comprises from about 0.1 wt. % to about 10.0 wt. % of said catalyst.

4. The process of claim 1 wherein said non-noble transitional metal comprises a metal included in the group comprising copper, nickel, cobalt, iron, chromium, molybdenum, tungsten, vanadium or titanium.

5. The process of claim 4 wherein said transitional metal comprises chromium.

6. The process of claim 1 wherein said crystalline aluminosilicate is included in the group comprising X type zeolite, Y type zeolite or mordenite.

* * * * *